US005817380A

United States Patent [19]

Tanaka

[11] Patent Number: 5,817,380

[45] Date of Patent: Oct. 6, 1998

[54] SNAP-ZIPPER AND BAG WITH THE SAME

[75] Inventor: Kenichi Tanaka, Himeji, Japan

[73] Assignee: Idemitsu Petrochemical Co., Ltd., Tokyo, Japan

[21] Appl. No.: 827,644

[22] Filed: Apr. 10, 1997

[30] Foreign Application Priority Data

Apr. 12, 1996 [JP] Japan ..... 8-090931

[51] Int. Cl.[6] ..... B65D 33/25

[52] U.S. Cl. ..... 428/35.7; 428/35.2; 428/99; 428/100; 428/33; 428/213; 383/97; 383/63; 220/253; 220/350

[58] Field of Search ..... 428/35.7, 36.2, 428/99, 100, 33, 213; 383/97, 63; 220/253, 350

[56] References Cited

U.S. PATENT DOCUMENTS 5,645,905 7/1997 Tanaka et al. ..... 428/35.7

FOREIGN PATENT DOCUMENTS 5-331324 12/1993 Japan .

*Primary Examiner*—Charles Nold

*Attorney, Agent, or Firm*—Flynn, Thiel, Boutell & Tanis, P.C.

[57] ABSTRACT

A snap-zipper 10 comprises a male and a female member 11 and 12 having strip-like bases 21 and 22 for fusion bonding, the bases being made of an ethylene·α-olefin copolymer with a MI of 0.3 to 15 g per 10 min., a density of 0.850 to 0.935 g/ml, a molecular weight distribution of 2 to 5, a molecular-weight-dependent width of branch number of 0 to 5 per 1,000 carbon atoms, an olthodichloroenzene soluble component content of 10% by weight or below, and a maximum melting point determined with a differential scan calorimeter of 115° C. or below. A bag 30 with a snap-zipper is obtained by fusion bonding the stems 21 and 25 of the snap-zipper 10 to a bag body 31.

16 Claims, 1 Drawing Sheet

SNAP-ZIPPER AND BAG WITH THE SAME

BACKGROUND OF THE INVENTION

1. Field of the Invention

This invention relates to a snap-zipper and bags with the snap-zipper and, more particularly to bags used to pack foods and medicines.

2. Description of the Prior Art

Bags (or bags with snap-zippers) which can be opened and closed by disengaging and engaging a strip-like snap-zipper comprising a male member and a female member, find extensive applications to the packing of foods, medicines, sundries and other goods, and various methods for manufacturing such bags with a snap-zipper have been proposed.

Among these methods are (1) one-piece bag body film with a snap-zipper is extrusion molded, (2) a snap-zipper is extrusion molded on a bag body film, and (3) a tape with a snap-zipper is formed in advance and then bonded by fusion to a bag body film.

Among these methods (1) to (3), the method (3) is most usual from the standpoints of the cost of manufacture, storage, and so forth.

The snap-zipper is usually made of the same material as a sealant layer which is a bag body film layer with the snap-zipper fusion bonded thereto. Where the sealant layer is made of a polyethylene type material, low density polyethylene (LDPE) or linear low density polyethylene (L-LDPE), i.e., a resin of the same type, is used as the material of the snap-zipper.

With prior art snap-zippers made of LDPE or the like, a shrinkage stress generated in an MD direction (i.e., direction of movement of the snap-zipper) in their manufacture may be present. When the snap-zipper is bonded by fusion to the bag body, the stress is alleviated by the heat of fusion, and also the volume of the snap-zipper is reduced by fusion and re-crystalization. As a result, wrinkles are generated in the fused portions of the snap-zipper and the bag body and deteriorate the commercial value of the bag. The generation of wrinkles is the more pronounced the higher the fusion temperature.

An object of the invention is to provide a bag with a snap-zipper, which permits the fusion bonding of the snap-zipper to the bag body to be done at a low temperature to reliably prevent wrinkle generation in the snap-zipper portion fusion bonded to the bag body.

SUMMARY OF THE INVENTION

The invention features a snap-zipper which comprises a male and a female member, which each have a stem for fusion bonding to a bag body and an engaging portion, the engaging portions being engaged with each other, the stems being made of ethylene·α-olefin copolymer with a melt index of 0.3 to 15 g per 10 sec., a density of 0.850 to 0.935 g/ml, a molecular weight distribution defined as numerical mean molecular weight divided by numerical mean molecular weight of 2 to 5, a molecular-weight-dependent width of branch number of 0 to 5 per 1,000 carbon atoms, an orthodichlorobenzene (ODCB) soluble content of 10% by weight or below, and a maximum melting point (Tm(max)) determined by differential scan calorimeter (DSC) of 115° C. or below.

The ethylene·α-olefin copolymer is obtainable by copolymerizing ethylene and α-olefin with a carbon number of 3 to 10 with a transition metal compound used as a catalyst, and it can be prepared by a usual copolymerizing process, such as a slurry copolymerization process, a gas phase copolymerization process, a solution copolymerization process, and a suspension copolymerization process (see Japanese Laid-Open Patent Publication No. 5-331324).

The MI is measured under conditions conforming to JIS K-7210.

The MI of the ethylene·α-olefin copolymer according to the invention is 0.3 to 15 g per 10 min., preferably 2 to 12 g per 10 min. When the MI is below 0.3 g per 10 min., the production rate is low, possibly resulting in rough molding surface. When the MI is above 15 g per 10 min., on the other hand, it is difficult to hold the shapes of the male and female members.

The density is measured under conditions conforming to JIS K-6760, and it can be measured by an anneal-less density gradient piping process.

The density of the ethylene·α-olefin copolymer according to the invention is 0.850 to 0.935 g/ml, preferably 0.880 to 0.920 g/ml, more preferably 0.890 to 0.910 g/ml. When the density is 0.850 g/ml, the snap-zipper would have low rigidity and become sticky with the lapse of time. When the density is above 0.935 g/ml, a seal property at low temperatures can no longer be obtained.

The molecular weight distribution can be determined by using a measuring instrument, which is obtained by connecting Differential Viscometer Model 110 (manufactured by Viscotek Inc.) to GPC Measuring Instrument Model M150C (manufactured by Waters Inc.). The measurement may be made using two Columns Shodex UT-8061, at a sampling rate of 2 mg/ml, at a temperature of 135° C., at a flow rate of 1 ml/min., and at a trichlorobenzene (TCB) solvent supply rate of 200 μg. The molecular weight distribution Mw/Mn can be determined from the absolute molecular weights Mw and Mn obtained by the measurement under the above conditions.

The molecular weight distribution of the ethylene ·α-olefin copolymer according to the invention is 2 to 5, preferably 2.5 to 4.5. When the molecular weight distribution is below 2, the resin pressure would be high, resulting in an inferior extrusion characteristic. In addition, the fusion elasticity would be low, resulting in unstable fused resin and deteriorated moldability. When the molecular weight distribution is above 5, high and low molecular weight components would be increased, so that satisfactory physical properties can not be obtained.

The molecular-weight-dependent width of branch number can be determined by using GPC Measuring Instrument M150C (manufactured by Waters Inc.) and FTIR (manufactured by Perkin Elmer Inc., 1760) for measuring the ranching degree). Specifically, the molecular weight distribution was determined by using two Columns Shodex UT-806L, at a sampling rate of 5 mg/ml, at a temperature of 35° C. at a flow rate of 1 ml/min., and using trichlorobenzene (TCB) as solvent. The molecular weight distribution thus determined was divided into 10 divisions, and the mean branch number of each division, i.e., the difference between the maximum and minimum branch numbers for each molecular weight, was determined with the FTIR as the molecular-weight-dependent width (the division with division areas of 4% and low being cut off).

The molecular-weight-dependent width of branch number of the ethylene·α-olefin copolymer according to the invention is 0 to 5 per 1,000 carbon atoms, preferably 0 to 4 per 1,000 carbon atoms. This means that the branch number of the copolymer is not substantially different irrespective of the molecular weight (i.e., whether the molecular weight is high or low). In other words, the difference between the maximum and minimum branch numbers ranges from 0 to 5 for 1,000 carbon atoms in all molecular weight parts of the copolymer. When this molecular-weight-dependent width is above 5, the resin would be sticky, resulting in deteriorated engagement. In addition, the heat seal property is deteriorated by a melting temperature increase.

The ODCB soluble component content can be determined as follows. 100 mg of sample is dissolved in 20 ml of ODCB at 135° C., and then is adsorbed to a column filled with Chromosol P by gradual cooling down to 35° C. Then by increasing the column temperature at a constant rate the concentration in the solution flowing out from the column is detected using an IR detector. Then, the concentration ratio (weight percentage) of the component not adsorbed at 35° C. and all the system is determined as the ODCB soluble component content.

The ODCB soluble component content is a criterion as to whether high branch components are many or little. When this value is high, many high branch components are contained.

The ODCB soluble component content in the ethylene·α-olefin copolymer according to the invention is 10% by weight or below, preferably 7% by weight or below. When the ODCB content is above 10% by weight, the heat seal property is deteriorated.

The maximum melting point (Tm(max)) based on DSC can be obtained as follows. DSC Series 7 TAS (manufactured by Parkinelmer Inc.) is used. A sampling rate of 10 mg/ml is held for 30 minutes at 190° C. Then, the temperature is raised at 190° C. for 3 min., then lowered at a rate of −10° C./min. down to 25° C., then held at 25° C. for 3 min. and then raised again at a rate of 10° C./min. up to 140° C. In this way, the peak temperature is determined as the maximum melting temperature (Tm(max)).

(Tm(max)) is a criterion as to whether low branch components are much or little. When this value is large, much high branch components are contained.

The (Tm(max)) of the ethylene·α-olefin copolymer according to the invention is 115° C. or below, preferably 113° C. or below. When (Tm(max)) is above 115° C., the transparency and heat seal property improving effects are deteriorated.

Another snap-zipper according to the invention comprises a male and a female member, which each have a stem for fusion bonding to a bag body and an engaging portion, the engaging portions being engaged with each other, the stems being made of a mixture of low-density polyethylene and an ethylene·α-olefin copolymer with a melt index (MI) of 0.3 to 15 g per 10 min., a density of 0.8050 to 0.935 g/ml, a molecular weight distribution defined as the weight mean molecular weight Mw divided by the numerical mean molecular weight Mn of 2 to 5, a molecular-weight-dependent width of branch number of 0 to 5 per 1,000 carbon atoms, an orthodichlorobenzene (ODCB) soluble component content of 10% by weight or below, and a maximum melting point (Tm(max)) determined with differential scan calorimeter (DSC) of 115° C. or below, the mixture containing 60 to 95% by weight of ethylene·α-olefin copolymer.

The ethylene·α-olefin copolymer in this case has the same physical properties as in the first-mentioned snap-zipper according to the invention.

According to the invention, the stems of the male and female members contain low-density polyethylene, and the shape holding property can be improved compared to the case of using ethylene α-olefin copolymer in situ.

The low-density polyethylene suitably has a density of 0.90 to 0.94 g/ml, and it may be ethylene monomer, linear low-density polyethylene, etc.

As for the proportions of the ethylene·α-olefin copolymer and the low-density polyethylene according to the invention, the former is 60 to 95% by weight, that is, the latter is 40 to 5% by weight. Preferably, the former is 95 to 96% by weight, that is, the latter is 5 to 35% by weight. More preferably, the former is 95 to 80% by weight, that is, the latter is 5 to 20% by weight.

When the proportion of the ethylene·α-olefin copolymer is below 6% by weight, a sufficient low temperature seal property could not be obtained.

The MI of the mixture of low-density ethylene and ethylene·α-olefin copolymer is suitably 1 to 20 g per 10 min., preferably 2 to 12 g per 10 min. When the MI is below 1 g per 10 min., the production rate would be low, possibly resulting in rough molding surface. When the MI is above 20 g per 10 min., it would be difficult to hold the shapes of the male and female members.

The above engaging portions may be formed by using low-density polyethylene.

The low-density polyethylene suitably has a density of 0.90 to 0.94 g/ml, and it may be an ethylene monomer or linear low-density polyethylene.

The low-density polyethylene suitably has an MI of 1 to 20 g per 10 min., preferably 2 to 12 g per 10 min. An MI below 1 g per 19 min. would result in a reduced production rate and possible rough molding surfaces. An MI above 20 g per 10 min., on the other hand, makes it difficult to hold the shapes of the male and female members.

The male and female members may be of any shape so long as their engaging portions can engage with each other. For firm fusion bonding, however, the male and female members suitably have strip-like stems. To ensure excellent engagement strength, the engaging portion of the female member suitably has a pair of hook portions extending in the longitudinal direction of the stem. The engaging portion of the male member, on the other hand, suitably has a head portion with a heart-like sectional profile which can be detachably received between the pair hook portions, and a coupling portion coupling the head portion and the stem to each other.

The invention further features a bag with a snap-zipper, which comprises a male and a female member fusion bonded to a bag body and each having a stem fusion bonded to the bag body and an engaging portion, the engaging portions being engaged with each other, the stem portions being made of an ethylene·α-olefin copolymer with a melt index of 0.3 to 15 g per 10 min., a density of 0.850 to 0.935 g/ml, a molecular weight distribution defined as the weight mean molecular weight divided by the numerical mean molecular weight of 2 to 5, a molecular-weight-dependent width of branch number of 0 to 5 per 1,000 carbon atoms, an orthodichlorobenzene soluble component content of 10% by weight or below, and a maximum melting point determined by a differential scan calorimeter of 115° C. or below.

The invention yet further features a bag with a snap-zipper, which comprises a male and a female member fusion bonded to a bag body and each having a stem fusion bonded to the bag body and an engaging portion, the engaging portions being engaged with each other, the stem portions being made of a mixture Of low-density polyethylene and an ethylene·α-olefin copolymer with a melt index of 0.3 to 15 g per 10 min., a density of 0.850 to 0.935 g/ml, a molecular weight distribution defined as the weight mean molecular weight divided by the numerical mean molecular weight of 2 to 5, a molecular-weight-dependent width of branch number of 0 to 5 per 1,000 carbon atoms, an orthodichlorobenzene soluble component content of 10% by weight or below, and a maximum melting point defined with a differential scan calorimeter of 115° C., the mixture containing 60 to 95% by weight of ethylene·α-olefin copolymer.

In the bag with a snap-zipper according to the invention, the snap-zipper has its stems fusion bonded to the bag body.

The bag body may be of any resin permitting fusion bonding of the snap-zipper to it, but is suitably of the ethylene·α-olefin copolymer noted above. In this case, the snap-zipper can be fusion bonded to the bag body at a low temperature, and wrinkle generation can be reliably prevented.

Where the bag body is made from a laminate comprising a plurality of layers, at least a sealant layer with the snap-zipper fusion bonded thereto is of the ethylene·α-olefin copolymer noted above.

DETAILED DESCRIPTION OF THE PREFERRED EMBODIMENT

[Embodiment of the Invention]

Figure 1:
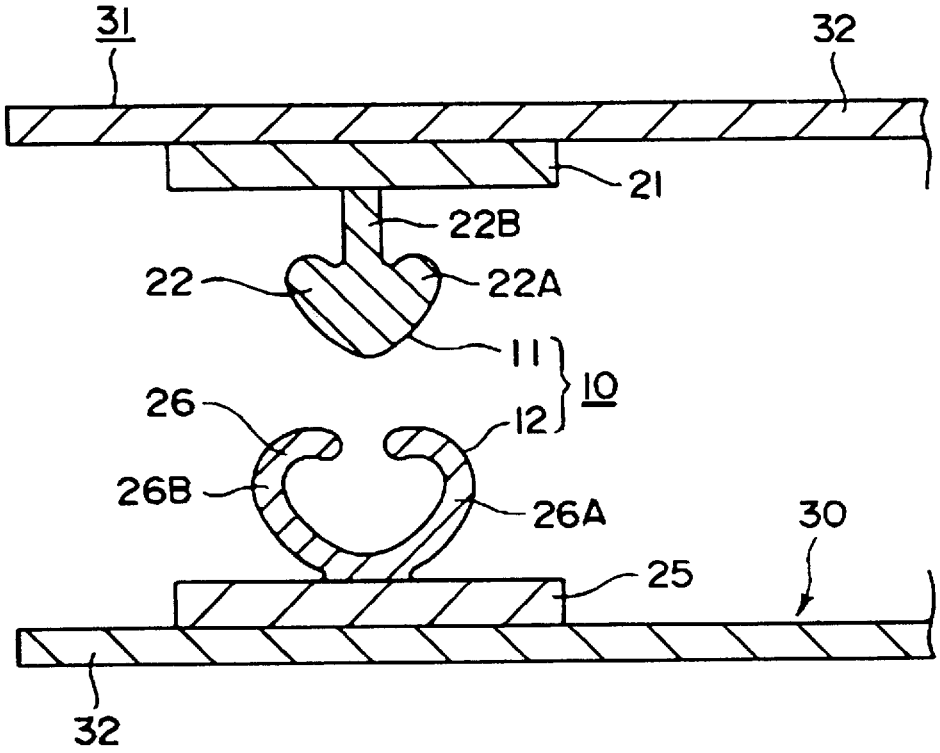
FIG. 1 is a sectional view showing a snap-zipper and a bag with the same embodying the invention.
Figure 2:
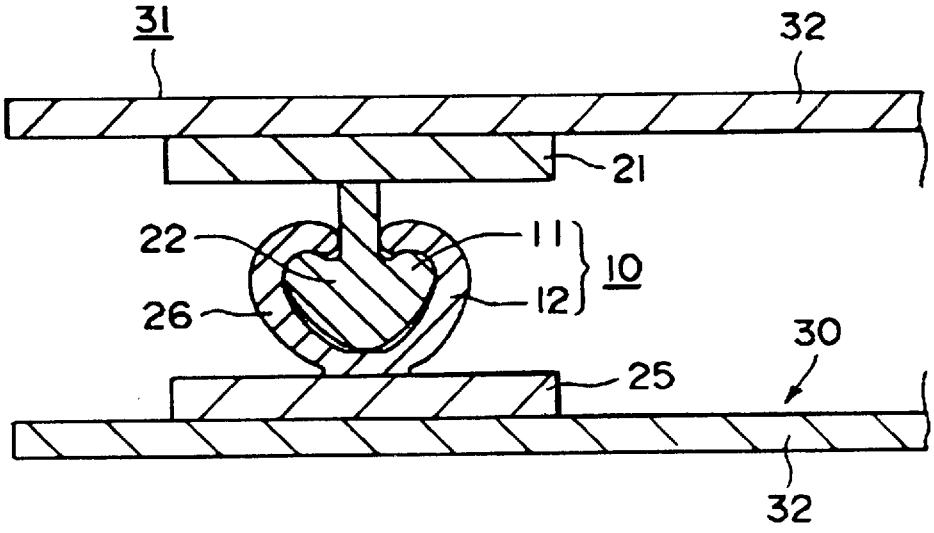
FIG. 2 is a sectional view showing the embodiment of the snap-zipper and the bag with the same.

As shown in FIGS. 1 and 2, the snap-zipper embodying the invention comprises a strip-like male member 11 and a female member 12, which is also strip-like and to be engaged with the male member 11.

The male member 11 has a strip-like base 21 which is bonded by fusion to a bag body 31, and an engaging portion 22 having an engaging function. The engaging portion 22 has a head portion 22A with a heart-like sectional profile and a coupling portion 22B with a bar-like sectional profile, which couples together the head portion 22A and the strip-like base 21.

The female member 12 has a strip-like stem 25 which is bonded by fusion to the bag body 31, and an engaging portion 26 having an engaging function. The engaging portion 26 has a first and a second hook portion 26A and 26B with an arcuate sectional profile, which are bonded by fusion to the strip-like stem 25.

The strip-like bases 21 and 25 and engaging portions 22 and 26 of the male and female members 11 and 12 are made of ethylene·α-olefin copolymer.

The ethylene·α-olefin copolymer has an MI of 0.3 to 15 g per 10 min., a density of 0.850 to 0.935 g/ml, a molecular weight distribution of 2 to 5, a molecular-weight-dependent width of branch number of 0 to 5 per 1,000 carbon atoms, an ODCB soluble component content of 10% by weight or below, and a Tm(max) determined with DSC of 115° C. or below.

The male member 11 in the embodiment may be fabricated by fusion bonding together the strip-like base 21 and the engaging portion 22 by co-extruding. The female member 12 may also be fabricated by fusion bonding together the strip-like base 25 and the engaging portion 26 by co-extruding.

The bag 30 with a snap-zipper embodying the invention comprises the snap-zipper 10 and the bag body 31 as described above. The male and female members 12 and 12 of the snap-zipper 10 have their strip-like bases 21 and 22 fusion bonded to the film 32 of the bag body 31.

While in the embodiment of the snap-zipper 10 the bases 21 and 25 and engaging portions 22 and 25 of the male and female members 11 and 12 are made of ethylene·α-olefin copolymer, it is also possible to use low-density polyethylene for the engaging portions 22 and 26.

It is also possible to use a mixture of the low-density polyethylene and ethylene·α-olefin copolymer with the physical properties mentioned above for the strip-like bases 21 and 25 and engaging portions 22 and 25.

It is further possible to use the mixture of low-density polyethylene and ethylene·α-olefin copolymer for the strip-like bases 21 and 22, and the low-density polyethylene for the engaging portions 22 and 26.

[EXAMPLE 1]

The strip-like bases 21 and 22 and engaging portions 22 and 26 of the embodiment of the snap-zipper as described above were formed by using ethylene·α-olefin copolymer with an MI of 6 g/min., a density of 0.80 g/ml, a molecular weight distribution of 4.1, molecular-weight-dependent width of branch number of 3.9 per 1,000 carbon atoms, an ODCB soluble component content of 3.0% by weight, and a Tm(max) determined with DSC of 95° C.

As the film 32 of the bag body 31 was used a 15 μm two-layer laminate film comprising two-axis-rolled nylon film and a 40 μm linear low-density polyethylene (L-LDPE) film.

The L-LDFE film of the film 32 was used as a sealant layer. To this sealant layer, the strip-like bases 21 and 25 of the snap-zipper 10 were bonded with a snap-zipper seal pressure of 1 kg/cm$^2$ and at a rate of 60 shots per min.

[EXAMPLE 2]

The strip-like bases 21 and 22 and engaging portions 22 and 26 were formed using a mixture of the ethylene·α-olefin copolymer used in Example (80% by weight) and linear low-density polyethylene with an MI of 6 g per 10 min. and a density of 0.94 g/ml.

The film 32 of the bag body 31 was the same as in Example 1. Using the above bag body 31 and the snap-zipper 10, a bag with a snap-zipper was produced in the manner as in Example 1.

[EXAMPLE 3]

In the embodiment described above, the strip-like stems 21 and 22 were formed using the ethylene·α-olefin copolymer used in Example, and the engaging portions 22 and 26 were formed using the same L-LDPE as used for the snap-zipper 10 in Example 2.

The film 32 of the bag body 31 was the same as in Example 1, a bag with a snap-zipper was produced in the same manner as in Example 1.

[EXAMPLE 4]

The snap-zipper 10 was the same as in Example 3.

As the film 32 of the bag body 31 was used a two-layer laminate film comprising a 15 μm two-axis-rolled nylon film and a 40 μm ethylene·α-olefin copolymer film. The ethylene·α-olefin copolymer film was of the same material as the strip-like stems 21 and 25 of the embodiment of the snap-zipper 10.

The ethylene·α-olefin copolymer film of the film 32 was used as a sealant layer, and the engaging portions 21 and 25 of the snap-zipper 10 were fusion bonded to this sealant layer with a snap-zipper seal pressure of 1 kg/cm$^2$ and at a rate of 60 shots per min.

[Contrast Example 1]

The engaging portions 22 and 26 of the strip-like bases 21 and 25 were formed using the same L-LDPE as used for the snap-zipper 10 in Embodiment 2.

The film 32 of the bag body 31 was the same as in Example 1, and a bag with a snap-zipper was produced in the same manner as in Example 1.

[Contrast Example 2]

The engaging portions 22 and 26 of the strip-like stems 21 and 25 were formed using a mixture of the same ethylene·α-olefin copolymer as used for the snap-zipper 10 in Embodiment 2 and L-LDPE. As for the proportions of the resin components of the mixture, the ethylene·α-olefin copolymer was 40% by weight, while the L-LDPE was 60% by weight.

The film 32 of the bag body 31 was the same as in Example 1, and a bag with a snap-zipper was produced in the same manner as in Example 1.

Of Examples 1 to 4 and Contrast Examples 1 and 2 of the bag 30 with a snap-zipper, the low temperature seal property and the seal wrinkles of the zone of fusion bonding between the strip-like stems 21 and 25 and the film 32 of the bag body 31 were examined. The results are shown in Table 1.

The seal property was determined by measuring the snap-zipper seal temperature, which is necessary for obtaining the actually necessary fusion bonding strength when fusion bonding the strip-like stems 21 and 25 to the film 32. The cross mark represents cases in which snap-zipper seal temperature is not substantially different from that in Contrast Example 1, the triangle mark represents those in which the temperature difference from the temperature in Contrast Example 1 is below 5° C., the single circle mark represents those in which the temperature difference is between 5° C. and 10° C., and the double circle mark represents those in which the temperature difference is above 10° C.

The seal wrinkles in the zone of fusion bonding between the strip-like stems 21 and 25 and the film 32 were determined on the basis of observation of the wrinkles by ten persons. The following five different grades were provided. In the Table, average grades are shown.

5-point grade: Wrinkles are extremely pronounced.

4-point grade: Wrinkles take particular attention.

3-point grade: Wrinkles are ordinary.

2-point grade: Wrinkles don't take particular attention.

1-point grade: Wrinkles are not substantially recognized.

TABLE 1

| | Sealant layer material | Snap-zipper seal temp | Seal wrinkles of fusion-bonded portions |
|---|---|---|---|
| Example 1 | L-LDPE | ○ | 2.3 |
| Example 2 | L-LDPE | Δ | 2.5 |
| Example 3 | L-LDPE | ○ | 2.0 |
| Example 4 | Ethylene.α-olefin copolymer | ◎ | 1.8 |

TABLE 1-continued

| | Sealant layer material | Snap-zipper seal temp | Seal wrinkles of fusion-bonded portions |
|---|---|---|---|
| Cont. Ex. 1 | L-LDPE | — | 4.1 |
| Cont. Ex. 2 | L-LDPE | × | 3.5 |

As is seen from Table 1, in Examples 1 to 4, in which the strip-like stems 21 and 25 of the snap-zipper 10 contain an ethylene·α-olefin copolymer with an MI of 0.3 to 15 g per 10 Min., a density of 0.850 to 0.935 g/ml, a molecular weight distribution of 2 to 5, molecular-weight-dependent width of branch number of 0 to 5 per 1,000 carbon atoms, an ODCB soluble component of 10% by weight or below, and a Tm(max) determined by DSC of 115° C. or below, the snap-zipper seal temperature of the strip-like stems 1 and 25 is low compared to the case of contrast Example 1 of the snap-zipper 10 mode of sole L-LDPE, and a satisfactory low temperature seal property is obtainable.

In Examples 1, 3 and 4, since the strip-like bases 21 and 25 are made of ethylene·α-olefin copolymer, snap-zipper seal temperature is lower by 5° C. or more than that in Contrast Example 1, so that a particularly excellent low temperature seal property is obtainable.

It will be further seen from the table that in Example 4, in which the sealant layer of the film 32 of the bag body 41 is made from the ethylene·α-olefin copolymer film which is of the same material as the strip-like bases 21 and 25, the most excellent low temperature seal property is obtainable.

It will be seen from the Table that in Examples 1 to 4, since the snap-zipper 10 can be fusion bonded to the bag body 31 at low melting temperatures, wrinkles are generated to such extents as to take no particular attention, that is, their generation can be substantially prevented.

In Example 4, since the sealant layer of the film 32 is made form the ethylene·α-olefin copolymer film which is of the same material as the strip-like stems 21 and 25, the melting temperature may be lowest, and it is possible to obtain a particularly excellent effect of preventing the wrinkle generation.

In contrast Example 2, the material of the strip-like bases 21 and 25 and the engaging portions 22 and 26 contains much L-LDPE compared to Example 2 while having an ethylene·α-olefin copolymer content of 60% by weight or below. Therefore, a sufficient low temperature seal property cannot be obtained, and also the wrinkle generation is pronounced.

What is claimed is:

1. A snap-zipper comprising a male and a female member, said male and female members each having a stem for fusion bonding and an engaging portion, said engaging portions being engaged with each other;

said stems being made of an ethylene·α-olefin copolymer with a melt index of 0.3 to 15 g/ml, a density of 0.850 to 0.935 g/ml, a molecular weight distribution defined as the weight mean molecular weight divided by the numerical mean molecular weight of 2 to 5, a molecular-weight-dependent width of branch number of 0 to 5 per 1,000 carbon atoms, an orthodichlorobenzene soluble component content of 10% by weight or below, and a maximum melting point determined with a differential scan calorimeter of 115° C. or below.

2. The snap-zipper according to claim 1, wherein:

said engaging portion is made of low-density polyethylene.

3. The snap-zipper according to claim 2, wherein:

said stems of said male and female members are strip-like in shape;

said engaging portion of said female member has a pair of hook portions extending in the longitudinal direction of said stem; and said engaging portion of said male member has a head portion with a heart-like sectional profile extending in the longitudinal direction of said stem and capable of being detachably engaged between said pair hook portions, and a coupling portion coupling said head portion and said stem to each other.

4. A snap-zipper comprising a male and a female member, said male and female members each having a stem for fusion bonding and an engaging portion, said engaging portions being engaged with each other;

said stems being made of a mixture of low-density polyethylene and an ethylene·α-olefin polymer with a melt index of 0.3 to 15 g/ml, a density of 0.850 to 0.935 g/ml, a molecular weight distribution defined as the mean weight molecular weight divided by the numerical mean molecular weight of 2 to 5, a molecular-weight-dependent width of branch number of 0 to 5 per 1,000 carbon atoms, an orthodichlorobenzene soluble component content of 10% by weight or below, and a maximum melting point determined with a differential scan calorimeter of 115° C. or below.

5. The snap-zipper according to claim 4, wherein:

said low-density polyethylene has a density of 0.90 to 0.94 g/ml.

6. The snap-zipper according to claim 5, wherein:

said engaging portion is made of low-density polyethylene.

7. The snap-zipper according to claim 6, wherein:

said stems of said male and female members are strip-like;

said engaging portion of said female member has a pair of hook portions extending in the longitudinal direction of said stem; and said engaging portion of said male member has a head portion with a heart-like sectional profile extending in the longitudinal direction of said stem and capable of being detachably engaged between said pair of hook portions, and a coupling portion coupling said head portion and said stem to each other.

8. A bag with a snap-zipper, which comprises a male and a female member and is fusion bonded to a bag body, said male and female members each having a stem for fusion bonded and an engaging portion, said engaging portions being engaged with each other;

said stems being made of an ethylene·α-olefin copolymer with a melt index of 0.3 to 15 g/ml, a density of 0.850 to 0.935 g/ml, a molecular weight distribution defined as the weight mean molecular weight divided by the numerical mean molecular weight of 2 to 5, a molecular-weight-dependent width of branch member of 0 to 5 per 1,000 carbon atoms, an orthodichlorobenzene soluble component content of 10% by weight or below, and a maximum melting point determined with a differential scan calorimeter of 115° C. or below.

9. The bag with a snap-zipper according to claim 8, wherein:

said engaging portion is made of low-density polyethylene.

10. The bag with a snap-zipper according to claim 9, wherein:

said bag body has a sealant layer of said ethylene·α-olefin copolymer, said snap-zipper being fusion bonded to said sealant layer.

11. The bag with a snap-zipper according to claim 10, wherein:

said stems of said male and female members are strip-like in shape;

said engaging portion of said female member has a pair of hook portions extending in the longitudinal direction of said stem; and said engaging portion of said male member has a head portion with a heart-like sectional profile extending in the longitudinal direction of said stem and capable of being detachably engaged between said pair hook portions, and a coupling portion coupling said head portion and said stem to each other.

12. A bag with a snap-zipper, which comprises a male and a female member and is fusion bonded to a bag body, said male and female members each having a stem for fusion bonding and an engaging portion, said engaging portions being engaged with each other;

said stems being made of a mixture of low-density polyethylene and an ethylene·α-olefin copolymer with a melt index of 0.43 to 15 g/ml, a density of 0.850 to 0.935 g/ml, a molecular weight distribution defined as the weight mean molecular weight divided by the numerical mean molecular weight of 2 to 5, a molecular-weight-dependent width of branch number of 0 to 5 per 1,000 carbon atoms, an orthodichlorobenzene soluble component content of 10% by weight or below, and a maximum melting point determined with a differential scan calorimeter of 115° C. or below;

said mixture containing 60 to 95% by weight of ethylene·α-olefin copolymer.

13. The bag with a snap-zipper according to claim 12, wherein:

said low-density polyethylene has a density of 0.90 to 0.94 g/ml.

14. The bag with a snap-zipper according to claim 13, wherein:

said engaging portion is made of low-density polyethylene.

15. The bag with a snap-zipper according to claim 13, wherein:

said bag body has a sealant layer of said ethylene·α-olefin copolymer, said snap-zipper being fusion bonded to said sealant layer.

16. The bag with a snap-zipper according to claim 15, wherein:

said engaging portion of said female member has a pair of hook portions extending in the longitudinal direction of said stem; and said engaging portion of said male member has a head portion with a heart-like sectional profile extending in the longitudinal direction of said stem and capable of being detachably engaged between said pair hook portions, and a coupling portion coupling said head portion and said stem to each other.

* * * * *